US005806895A

United States Patent [19]

Sharabani

[11] Patent Number: 5,806,895

[45] Date of Patent: Sep. 15, 1998

[54] PLASTIC POSTCARD

[76] Inventor: Michael N. Sharabani, 812 Forrest Dr., Myrtle Beach, S.C. 29577

[21] Appl. No.: 852,475

[22] Filed: May 7, 1997

[51] Int. Cl.[6] ..... B42D 12/02; B42D 15/00

[52] U.S. Cl. ..... 283/61; 283/107; 283/110

[58] Field of Search ..... 283/61, 62, 117, 283/56, 2, 5, 107, 110; 229/93.8; 434/85, 81, 92; 428/15, 13, 42.1, 42.2

[56] References Cited

U.S. PATENT DOCUMENTS

| | | | |
|---|---|---|---|
| 4,542,039 | 9/1985 | Dowzall . | |
| 4,921,278 | 5/1990 | Shiang et al. | 283/87 |
| 5,009,626 | 4/1991 | Katz . | |
| 5,282,651 | 2/1994 | Alonso | 283/117 |
| 5,288,011 | 2/1994 | Yoshioka . | |
| 5,347,296 | 9/1994 | Lewicki, Jr. et al. . | |
| 5,484,502 | 1/1996 | Bozanic . | |
| 5,693,437 | 12/1997 | Malhotra . | |
| 5,699,956 | 12/1997 | Brennan . | |

*Primary Examiner*—Larry I. Schwartz
*Assistant Examiner*—Tisa Stewart
*Attorney, Agent, or Firm*—Dority & Manning, P.A.

[57] ABSTRACT

A postcard containing an image having an enhanced depth perceptional effect is disclosed. In one embodiment, the postcard is made by printing an image onto a clear plastic substrate. The image is printed on the backside of the substrate so that the image is visible from the opposite side. In order to provide the image with a three-dimensional effect, no ink is printed on selected portions of the postcard creating translucent portions surrounding the image.

22 Claims, 2 Drawing Sheets

Fig. 1
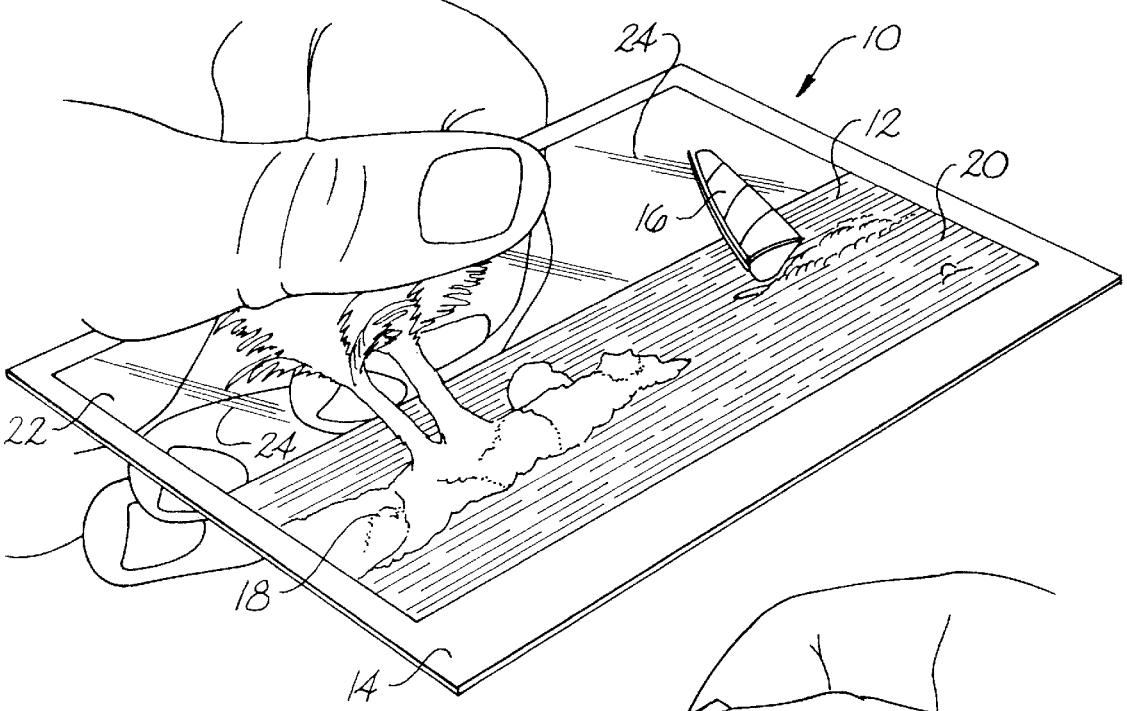
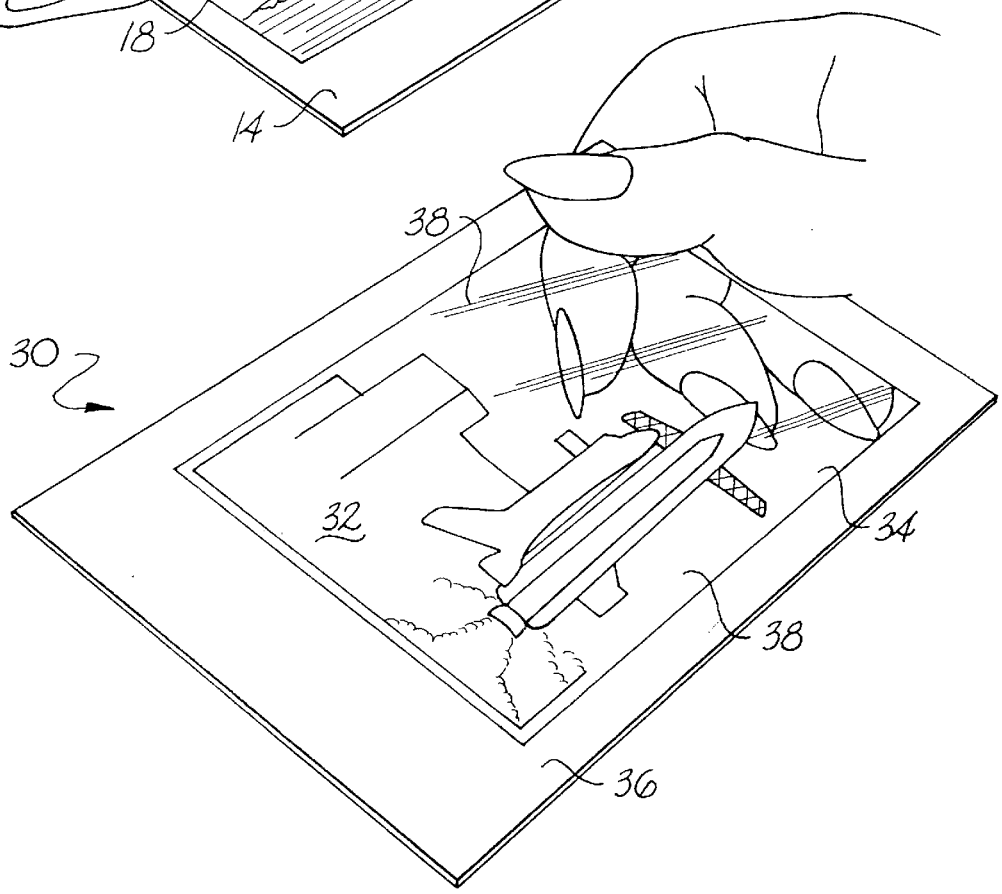
Fig. 2

PLASTIC POSTCARD

BACKGROUND OF THE INVENTION

The present invention generally relates to postcards, and more particularly to plastic postcards containing an image having an enhanced depth perceptional effect.

In general, a postcard refers to a card on which a message may be written. Typically, postcards are purchased by tourists, visitors, or travelers and mailed to relations, friends, and business associates. The cards are usually made by laminating a picture to cardboard or paperboard. The picture is usually of a scenic outdoor location, a historical landmark, or of some other significant place associated with the region in which the card was purchased.

The present invention is directed to an improved postcard in which the picture or image appearing on the card is enhanced and amplified. Specifically, through the process of the present invention, a postcard is produced containing a picture with enhanced depth perception.

SUMMARY OF THE INVENTION

The present invention is directed to various improvements concerning picture postcards. Thus, broadly speaking, one main object of the present invention is to provide an improved postcard.

It is another principle object of the present invention to provide postcards containing a picture having an enhanced depth perceptional effect.

It is another object of the present invention to provide postcards made from a translucent plastic film having a picture adhered to one side of the film.

It is a further object of the present invention to provide plastic postcards containing a picture in which various selected background portions have been deleted.

Additional objects and advantages of the invention are set forth in, or will be apparent to those of ordinary skill in the art, from the detailed description which follows. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to substitution of equivalent means and features or materials for those shown or discussed, and the functional or positional reversal of various parts, features, or the like.

Still further, it is to be understood that different embodiments, as well as different presently preferred embodiments, of this invention may include various combinations or configurations of presently disclosed features or elements, or their equivalents (including combinations or configurations thereof not expressly shown in the figures or stated in the detailed description). One exemplary such embodiment of the present invention relates to an improved postcard.

The postcard includes a translucent substrate made from a plastic film. The substrate has a first side and a second side. An image is applied to the substrate in a manner so that the image is visible from the first side. In accordance with the present invention, the postcard includes translucent portions contained on the substrate surrounding the image. The translucent portions enhance the appearance of the image giving the image an enhanced depth perceptional effect.

The postcard can further include a coating applied to a portion of the second side of the substrate. The coating is adapted to receive a written message thereon. For instance, in one embodiment, the coating can be made from a white opaque ink. The opaque ink can be an ultraviolet curable ink. Ultraviolet curable inks can also be used to apply the image to the card.

The translucent substrate can be made from polyvinyl chloride film. Typically, the postcard will have a width of from about 5 inches to about 6.5 inches and a length of from about 3.5 inches to about 4.5 inches. The plastic film for most applications should weigh less than 1 ounce and can be up to about 0.015 inches thick.

These and other objects of the present invention are also achieved by providing a postcard being produced according to a process including the steps of providing an image fixed in a tangible medium. The image contains a background and a foreground. Selected background portions of the image are then deleted and the image is printed onto a translucent plastic film. In particular, the image can be printed on to a first side of the film in a manner such that the image is visible from the reverse side. Once the image is printed onto the film, the film still contains translucent portions, however, where the selected background portions were deleted. The translucent portions give the image an enhanced depth perceptional effect.

In order to provide a place where a written message can be inscribed on the card, a coating, such as a white opaque ink, can be applied to the first side of the film.

In order to delete the selected background portions from the image, in one embodiment, the image can be entered into a computer. Once entered into the computer, computer software can be used to edit the image as desired. Once edited, the image can be transferred on to photographic film for making printing plates. The printing plates can be loaded into a printer for printing the image on to the translucent plastic film.

For instance, in one application, four different colored inks, such as ultraviolet curable inks, can be applied to the film sequentially by the printer in producing the image. The colored inks, for instance, can include blue, purplish red, yellow and black. It should be understood, however, that more or less colors may be used during the process.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which:

FIG. 1 is a perspective view of one preferred embodiment of the present invention;

FIG. 2 is a perspective view of another preferred embodiment of the present invention.

Figure 3:
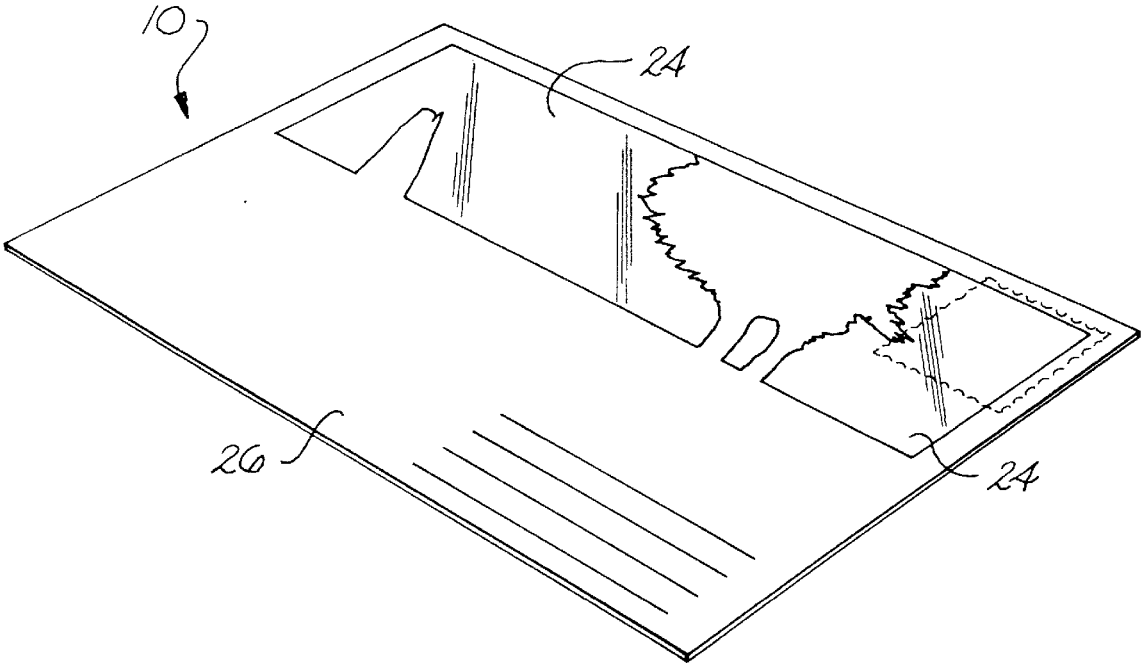
FIG. 3 is a perspective view of the back of the postcard illustrated in FIG. 1.

Repeat use of reference characters throughout the present specification and appended drawings is intended to represent same or analogous features or elements of the invention.

DETAILED DESCRIPTION OF PREFERRED EMBODIMENTS

Referenced will now be made in detail to the presently preferred embodiments of the invention, two complete examples of which are fully illustrated in the accompanying drawings. Each example is provided by way of an explanation of the invention, not limitation of the invention. In fact, it will be apparent to those skilled in the art that various modifications and variations can be made in the present invention. For instance, features illustrated or described as part of one embodiment can be used on another embodiment to yield a still further embodiment. Additionally, certain features may be interchanged with similar devices or features not mentioned yet which perform the same or similar functions. Thus, it is intended that the present invention cover such modifications and variations as come within the scope of the appended claims and their equivalents.

In general, the present invention is directed to plastic postcards having an enhanced depth perceptional effect. More particularly, the plastic postcards of the present invention are made so that the image appearing on the card has a three-dimensional appearance. Although the cards can be made to contain any suitable image, the cards are particularly well adapted to displaying action scenes and landscapes.

Referring to FIGS. 1–3, two embodiments of postcards made according to the present invention are illustrated. Referring to FIG. 1, a postcard generally 10 is shown. Postcard 10 includes an image 12 surrounded by a border 14. Border 14 can be made with any color or style that will accentuate the image.

In this embodiment, image 12 depicts a water scene containing a wind surfer 16 and an island 18, surrounded by an ocean 20. Image 12 is printed on a translucent plastic substrate 22.

In accordance with the present invention, as shown in FIG. 1, postcard 10 further includes selected translucent portions 24 created where image 12 does not appear on plastic substrate 22. More particularly, translucent portions 24 are created by deleting selected background portions from image 12. For instance, in the example shown in FIG. 1, the sky has been deleted from the image.

It has been discovered by the current inventor that by deleting selected background portions from image 12 and forming selected translucent portions 24 within postcard 10, image 12 is given an enhanced depth perceptional effect. Because of the translucent portions, the image appears to have three-dimensional characteristics. In this arrangement, image 12 on postcard 10 is much more striking, distinct and aesthetic than if the image appeared on a conventional cardboard postcard.

Referring to FIG. 3, the backside of postcard 10 is illustrated. From the backside of postcard 10, the outline of image 12 is visible. As will be described in more detail below, the backside of postcard 10 is coated with a coating 26, such as a white opaque ink, that is designed to receive pencil and ink marks for allowing a sender to inscribe an address and a message on the card. In the embodiment shown in FIG. 3, coating 26 covers the entire backside of image 12. Alternatively, however, coating 26 can be used to only coat a portion of postcard 10 sufficient in size to receive a message and an address.

Referring to FIG. 2, a second embodiment of a postcard generally 30 made in accordance with the present invention is illustrated. In this embodiment, postcard 30 includes an image 32 printed on a plastic, translucent substrate 34. As shown, image 32 depicts a space shuttle launch. Image 32 is surrounded by a border 36.

Similar to the postcard illustrated in FIG. 1, postcard 30 also includes translucent portions 38 where selected background portions of image 32 have been deleted. As described above, translucent portions 38 provide the image with enhanced depth perception and make objects in the image appear to have three-dimensional characteristics.

In general, in order to construct plastic postcards in accordance with the present invention, first an image is selected for the card. Background portions of the image are deleted in order to accentuate particular objects or scenes appearing in the image. The edited image is then transferred to a translucent plastic substrate in the shape of a postcard. Although the image can be printed upon the top surface of the plastic substrate, preferably the image is reverse printed on the backside of the plastic substrate in a manner that makes the image visible from the opposite side.

Although it is believed that the postcards can be made according to different methods, the following is a detailed description of one preferred embodiment for constructing postcards in accordance with the present invention.

In one embodiment of a process according to the present invention, after a particular image or picture is selected, the image is scanned into a device, such as a computer in order to edit the image as desired. For instance, a drum scanner such as a Crossfield 626 Scanner marketed by Crossfield Electronics Ltd. of Herthfordshire, England, can be used to scan the image. Drum scanners use a laser to scan an image appearing, for instance, on a photograph or the like onto computer readable tape, such as 8 mm tape. In order to scan images, drum scanners typically contain a computer loaded with specially designed software. For instance, the Crossfield 626 Scanner is typically loaded with CELSIS 6,000 software also marketed by Crossfield Electronics Ltd.

Once the image is scanned, the image can then be loaded onto a computer in order to perform any necessary editing steps. Alternatively, the image itself can be created on a computer. Regardless, there are numerous computer software programs available designed to allow a user to edit and modify an image in any desired manner. For instance, for producing postcards in accordance with the present invention, the computer software can be used to remove and delete selected background portions from the image. The deleted portions will later form translucent portions on the postcard, giving the image an enhanced depth perceptional effect.

Besides removing selected background portions from the image, once loaded on a computer, the image can be edited in various other ways. For instance, using the computer software, the image can be cropped to only capture particular portions of the image. During this step, the image can also be enlarged or reduced and enhanced. Enhancing the image, for instance, could involve editing the colors appearing in the image and retouching or modifying figures in the image. While loaded on the computer, other features can be added to the image if desired. For instance, a border can be placed around the image having a selected color and style that further serves to increase the aesthetic appeal of the picture. Also, if desired, text or copy can be added.

Particular computer software programs that can be used to edit the image include ADOBE Photoshop, marketed by Adobe Systems, Inc. of San Jose, Calif. and QUARK Express, marketed by Quark, Inc. of Denver, Colo. These programs are particularly well suited for use on APPLE computers such as a MACINTOSH computer.

After the image has been edited as desired, photographic film negatives corresponding to the final size of the postcard are prepared from the image. Specifically, a negative is made for each color that will be used to print the image on the postcard. For instance, if the image is going to be generated using a four color scheme, four negatives will be made corresponding to each color. The negative will indicate where a particular color is to be applied to the postcard.

In order to create the negatives from the computer image, a film processor can be used. For instance, one particular film processor that may be used is the GL 361 ONLINE MAGNUM marketed commercially by The Carnfeldt Company. If desired, the film processor can be connected directly to a computer for producing the negatives.

From each photographic negative, a printing plate can be made for printing the image onto the postcard. More particularly, each printing plate that is produced is used in a printing machine for applying a particular color, such as a colored ink, to the card. One particular device capable of producing a printing plate from a film negative is the AUTOLITH PN 85-negative plate processor marketed by EI DuPont de Nemours and Company of Wilmington, Del.

Once the printing plates are made, the plates are mounted to a printing press. Each color used in the printing press is then applied sequentially to a clear plastic substrate until an image is generated. One particular printing press that can be used in the process of the present invention is a HEIDELBERG press. A HEIDELBERG press applies colored inks to the plastic substrate using a roller located under each color head where each printing plate is mounted.

In one embodiment, each of the colored inks can be applied to the top of the substrate in order to generate the image. Alternatively, however, in a preferred embodiment, the inks are applied to the backside of the substrate in a manner such that the image can be viewed from the opposite side, which is referred to herein as reverse order printing. By printing the image from the backside of the plastic substrate, the image remains better protected, which is especially important when the postcard is mailed.

As described above, in one embodiment, four separate printing plates can be made corresponding to the use of four different colored inks in order to produce the image on the card. For example, it has been found that most any image or scene can be produced on a plastic substrate using only inks having the following colors: cyan (dark blue), magenta (deep purplish red), yellow and black. Through the use of the above colors, any desired color can be created on the card by printing the colors one on top of the other in a selected manner.

The type of inks used in the process of the present invention is generally not critical. The inks, however, must adhere to a plastic film without smearing. In one embodiment, ultraviolet cured inks are used. Such inks, which are typically solvent based, are commercially available from Mallard, Inc. and from Flint, Inc.

As described above, the inks are printed onto a plastic film, which is preferably translucent. In general, any clear plastic material can be used. One particular plastic film well suited for use in the present invention is clear rigid polyvinyl chloride film. As is standard for postcards, the plastic substrate will typically have a width of from about 3½ inches to about 4½ inches and a length of from about 5 inches to about 6½ inches.

In accordance with postal regulations, in order to avoid having to put excess postage on the card, in one embodiment, the postcard of the present invention should weigh no more than 1 ounce. When using clear polyvinyl chloride having the above-described length and width dimensions, it has been found that 15 point polyvinyl chloride can be used, which has a thickness of about $^{15}/_{1,000}$ of an inch. At this thickness, the polyvinyl chloride film has good rigidity for use as a postcard but yet still weighs less than 1 ounce.

Once the image is applied to the plastic postcard, according to the present invention, an opaque coating, such as a white ink is applied to the card. As shown in FIG. 3, in one embodiment, the opaque coating is applied directly to the printed image. The opaque coating applied to the image not only protects the image but also provides a surface where an address and written messages can be placed. In this regard, the coating that is applied to the card should readily accept ink and pencil marks. Such a coating can include the ultraviolet cured inks described above.

Once the ink and pencil receiving coating is applied to the postcard, if desired, dark colored lines and borders can be printed on the coating. The dark colored lines and borders can be made, for example, using a black ink. For instance, as shown in FIG. 3, lines can be printed on the back of the card to provide a place where an address can be filled in. Also, text can be placed on the back of the card if desired. For instance, a short description can be printed on the back of the card in order to indicate and describe the image appearing on the reverse side.

The opaque coating for receiving pen and ink marks and the dark colored lines and text can be applied to the postcard using the HEIDELBERG press described above. Specifically, the press can include two additional printing plates for applying the opaque coating and for applying the dark colored lines.

In one embodiment, a roll of plastic film can be fed through the printing press continuously. The printing press can apply colored inks sequentially until the image is formed. Once the image is applied to the film, the film can then be cut to shape for commercial use.

While particular embodiments of the invention have been described and shown, it will be understood by those of ordinary skill in the art that the present invention is not limited thereto since many modifications may be made. Therefore, it is contemplated by the present application to cover any and all such embodiments that may fall within the scope of the invention and the appended claims.

What is claimed is:

1. A postcard containing an image having an enhanced depth perceptional effect comprising:

a) a translucent substrate made from a plastic film, said substrate having a first side and a second side;

b) an image applied to said substrate, said image being visible from said first side of said substrate;

c) translucent portions contained on said substrate surrounding said image, said translucent portions enhancing the appearance of said image; and d) a coating applied to a portion of said second side of said substrate, said coating being adapted to receive a written message thereon.

2. A postcard as defined in claim 1, wherein said image is printed onto said translucent substrate.

3. A postcard as defined in claim 1, wherein said image is adhered to said second side of said substrate in a manner such that said image is visible from said first side.

4. A postcard as defined in claim 3, wherein said image is printed onto said substrate using ultraviolet curable inks.

5. A postcard as defined in claim 1, wherein said translucent portions are created by deleting selected portions from said image.

6. A postcard as defined in claim 1, wherein said plastic film comprises polyvinyl chloride.

7. A postcard as defined in claim 1, wherein said coating comprises a white opaque ink.

8. A postcard as defined in claim 1, wherein said postcard has a width of from about 5 inches to about 6.5 inches and a length of from about 3.5 inches to about 4.5 inches.

9. A postcard adapted to receive a written message thereon, said postcard being produced according to a process comprising the following steps:

a) providing an image fixed in a tangible medium, said image having a background and a foreground;

b) deleting selected background portions from said image;

c) printing said image onto a translucent plastic film, said film having a first side and a second side, said image being printed on said first side of said film in a manner such that said image is visible from said second side, wherein said film remains translucent where said selected background portions were deleted providing said image with an enhanced depth perceptional effect; and d) applying a coating to said first side of said film, said coating covering at least a portion of said image, said coating being adapted to receive a written message thereon.

10. A postcard produced according to the process defined in claim 9, further comprising the step of entering said image into a computer and using said computer to delete said selected background portions from said image.

11. A postcard as defined in claim 9, wherein said postcard has a width of from about 5 inches to about 6.5 inches and a length of from about 3.5 inches to about 4.5 inches.

12. A postcard as defined in claim 9, wherein said postcard weighs 1 ounce or less.

13. A postcard as defined in claim 9, wherein said translucent plastic film is at least 0.015 inches thick.

14. A postcard as defined in claim 9, wherein said translucent plastic film comprises a vinyl polymer.

15. A postcard as defined in claim 9, wherein said image is printed onto said plastic film using from two to six different colored inks.

16. A postcard as defined in claim 9, wherein said coating is a white opaque ink.

17. A postcard as defined in claim 9, wherein said image is printed onto said plastic film using a blue ultraviolet curable ink, a purplish red ultraviolet curable ink, a yellow ultraviolet curable ink, and a black ultraviolet curable ink.

18. A postcard, said postcard being produced according to a process comprising the following steps:

a) providing a picture, said picture having a background and a foreground;

b) entering an image reproduced from said picture into a computer;

c) deleting selected background portions from said image using said computer; and d) printing said edited image onto a translucent plastic film, said film having a first side and a second side, said image being printed onto said first side of said film such that said image is visible from said second side, wherein said film remains translucent where said selected background portions were deleted providing said image with an enhanced depth perceptional effect.

19. A postcard produced according to a process as defined in claim 18, further comprising the steps of capturing said edited image onto photographic film and making printing plates from said photographic film, said printing plates for printing said image onto said plastic film.

20. A postcard as defined in claim 18, wherein said process further comprises the step of coating said first side of said film with an opaque ink, said opaque ink covering at least a portion of said image for providing a space adapted to receive a written message.

21. A postcard as defined in claim 18, wherein said image is printed onto said translucent plastic film using four ultraviolet curable inks.

22. A postcard as defined in claim 21, wherein said translucent plastic film comprises polyvinyl chloride.

* * * * *